United States Patent [19]

Benz et al.

[11] Patent Number: 5,034,583

[45] Date of Patent: Jul. 23, 1991

[54] ELECTRIC SWITCHING DEVICE WHICH CAN BE CONTROLLED MECHANICALLY IN AN ADJUSTABLE WAY

[75] Inventors: Bernard Benz; Alain Pigat, both of Drôme, France

[73] Assignee: Sextant Avionique, France

[21] Appl. No.: 434,876

[22] Filed: Nov. 9, 1989

[30] Foreign Application Priority Data

Nov. 9, 1988 [FR] France ..... 88 15060

[51] Int. Cl.[5] ..... H01H 3/00

[52] U.S. Cl. ..... 200/329; 200/82 C; 200/82 R; 200/81.4; 200/332.1

[58] Field of Search ..... 200/251, 259, 286, 573, 200/551, 557, 329, 332, 1, 82 C, 82 A, 83 S, 82 R, 81.4; 73/745

[56] References Cited

U.S. PATENT DOCUMENTS

| | | | |
|---|---|---|---|
| 755,708 | 3/1904 | Schmitz | 200/82 R |
| 2,736,778 | 2/1956 | Buchanan | 200/82 C |
| 2,753,414 | 7/1956 | Stevenson | 200/82 C |
| 3,097,276 | 7/1963 | Ellett | 200/83 S |
| 3,300,600 | 1/1967 | Blomquist et al. | |
| 3,354,731 | 11/1967 | Kussmaul | |
| 3,937,912 | 2/1976 | Martin | 200/82 C |
| 4,389,551 | 6/1983 | Deibele et al. | 200/573 |
| 4,616,115 | 10/1986 | Potyka | 200/573 |
| 4,827,093 | 5/1989 | Strzodka | 200/82 C |

FOREIGN PATENT DOCUMENTS

| | | |
|---|---|---|
| 2033933 | 7/1970 | Fed. Rep. of Germany . |
| 7103624 | 11/1971 | France . |
| 7733681 | 6/1979 | France . |
| 8411766 | 1/1986 | France . |

*Primary Examiner*—Henry J. Recla
*Assistant Examiner*—Glenn T. Barrett
*Attorney, Agent, or Firm*—Rosenman & Colin

[57] ABSTRACT

An electric switching device for making or breaking the electric continuity between electric connecting elements under the action of an external force includes, in a single case, at least one electric switch having a control member therefor, a movable operating member specific to each switch mounted in the casing for sliding movement along the switch, a tapping in each operating member having its axis parallel to the sliding direction of the operating member, and a rod threadedly cooperating with each tapping, each threaded rod having a first end on which the external force is directly exerted and a second end which can be rotated by an appropriate tool passing through a wall of the case, and the operating member comprises a substantially cylindrical sleeve acting against a coaxially mounted resilient return member, the sleeve having a member directly cooperating with the control member of the switch.

4 Claims, 4 Drawing Sheets

ELECTRIC SWITCHING DEVICE WHICH CAN BE CONTROLLED MECHANICALLY IN AN ADJUSTABLE WAY

BACKGROUND OF THE INVENTION

1. Field of the Invention

The device of the invention relates to the field of electric switching and more particularly that of high speed switches of the type comprising in a small case, generally made from an insulating material, electric connecting elements and means for making or breaking the electric continuity between one or other of the electric connecting elements under the action of an external force.

2. Description of the Prior Art

This type of switch is described in particular in the French patent 77 33 681 or else 84 11 766, it is now widely used in different industrial sectors and particularly in the automobile field because of the increasing share of automatic devices and electronics in this field.

More precisely, the invention relates to a device comprising, in a single case, one or more electric switches and, for each switch, an adjustable control member.

From the patent US-A-3 354 731 an electric switching device is known for making or breaking the electric continuity between electric connecting elements under the action of an external force, comprising in a single case, at least one electric switch, operating means specific to each switch mounted for sliding laterally along one of the faces of the switch and a threaded rod for adjusting said operating means specific to each switch, cooperating with a tapping having its axis parallel to the sliding direction provided on said operating means.

This known device however is not easy to adjust, to the extent in particular that it requires two successive adjustments. In addition, in this device, the threaded rod is that of a screw whose head, abutting against the wall of the case, is necessarily outside the latter. The result is an appreciable size and difficulties in sealing the case when the device operates in a polluted atmosphere.

SUMMARY OF THE INVENTION

The present invention aims at overcoming the above drawbacks by providing a device which is simple to adjust, is accurate, sealed and compact.

For this, the present invention provides a device of the above defined type which is characterized by the fact that said threaded rod is provided with a first end external to the case on which said external force is exerted directly and a second end inside said case which can be rotated by an appropriate tool passing through the wall of said case.

In the device of the invention, a single adjustment is required. In addition, because the rotatable end of the threaded rod is inside the case, the latter may be readily sealed by closing, during normal operation the hole for inserting a tool.

In one embodiment, the operating means comprise a substantially cylindrical sleeve acting against a resilient return means mounted coaxially and the sleeve comprises a radial bracket cooperating directly with the control of the switch.

In another embodiment, the operating means comprise a substantially cylindrical sleeve acting against a coaxially mounted resilient return means and the sleeve comprises a ramp cooperating directly with the control of the switch.

Advantageously, the sleeve is made from a semi rigid thermoplastic material particularly from polyamide reinforced with glass fibres, and the threaded rod is of the three-lobe type.

BRIEF DESCRIPTION OF THE DRAWINGS

The invention will be better understood from the following description of an embodiment of the device of the invention more particularly intended for the automobile industry and comprising two electric switches actuated through their respective control means by a piston driven with a translational movement, with reference to the accompanying drawings in which.

DESCRIPTION OF THE PREFERRED EMBODIMENTS

The preferred embodiment of the device of the invention which is described hereafter is more particularly intended for motor vehicle equipment, usually called pressure switch by a man skilled in the art. The device described here operates two electric switches by the displacement of a piston subjected to a translational movement generated for example by oil pressure and a resilient return means, for example a spring.

Figure 1:
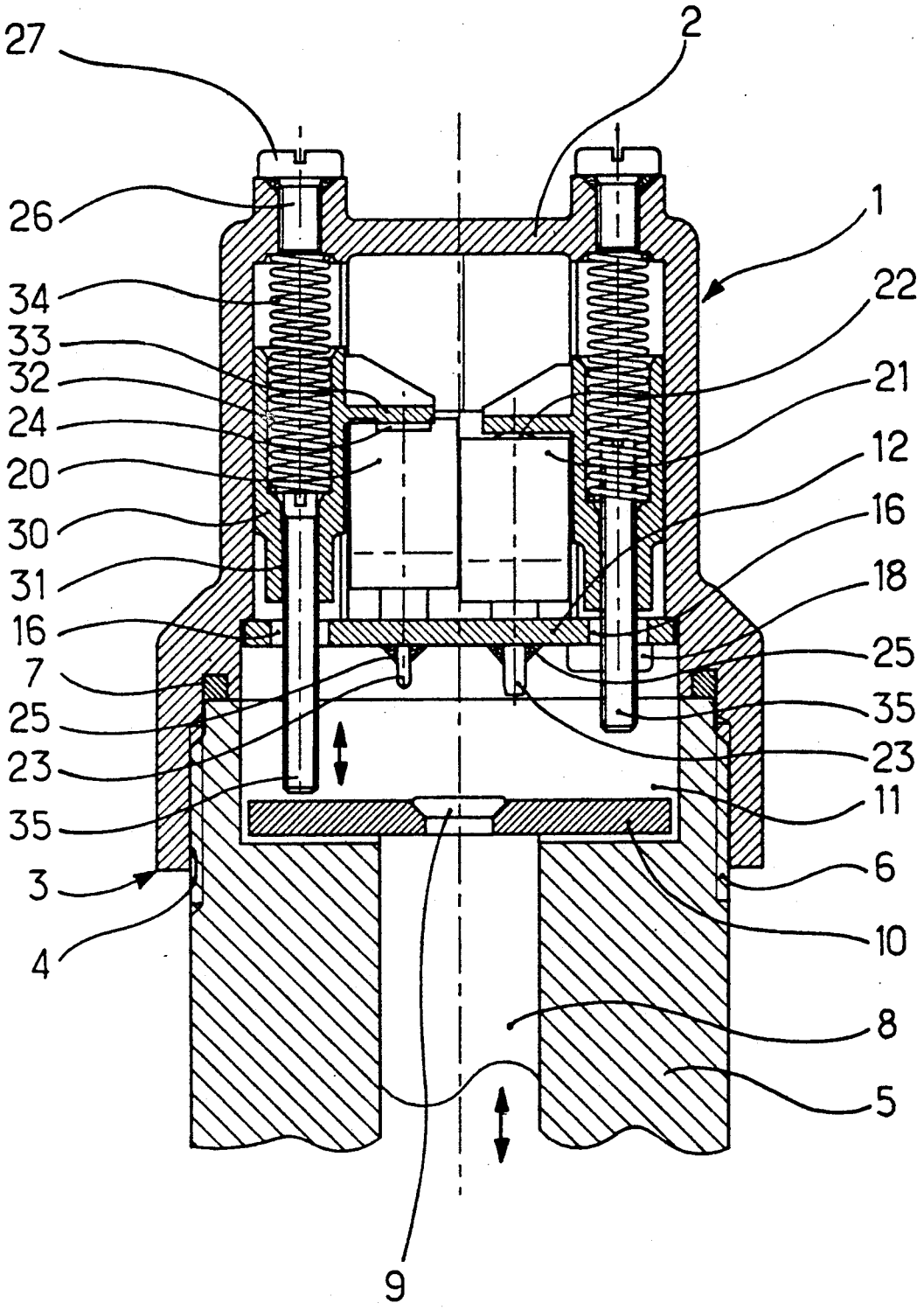
FIG. 1 is a sectional view of the device of the invention.

Referring to the drawings, and such as it is shown particularly in FIG. 1, the device of the invention comprises a case having a substantially cylindrical shape closed at one of its ends by a substantially flat and circular bottom 2; the opposite end in the shape of a circular crown 3 comprises a corresponding tapping 6; sealing between the head of cylinder 5 and case 1 is provided by an O-seal 7 housed in a circular groove formed in the thickness of case 1.

In the central part of cylinder 5, a piston 8 is mounted for sliding along its axis, the head of the piston is in the shape of a rivet 9 for cooperating with and fixing a circular washer 10 mounted in a plane orthogonal to the axis of the piston, the external diameter of the washer 10 corresponds substantially to the diameter of a recess 11 formed in the head of cylinder 5.

Recess 11 forms a cylindrical chamber whose flat face opposite washer 10 is formed by a circular plate 12 made from a rigid material, here a printed circuit board.

Board 12 serves as support for two electric switches 20, 21. The associated control means will be described further on.

Figure 2:
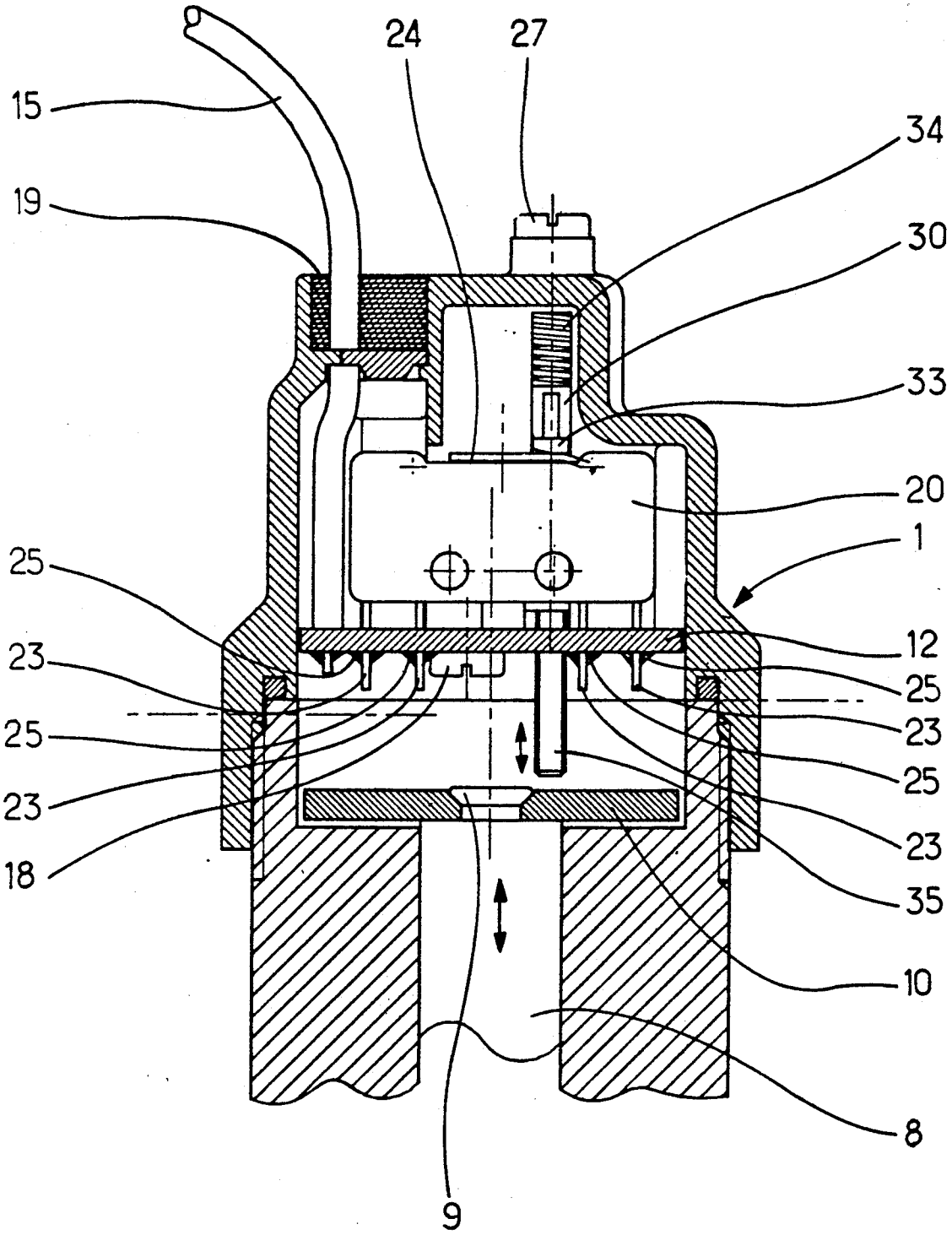
FIG. 2 is a sectional view of the device through a plane orthogonal to that of FIG. 1.
Figure 3:
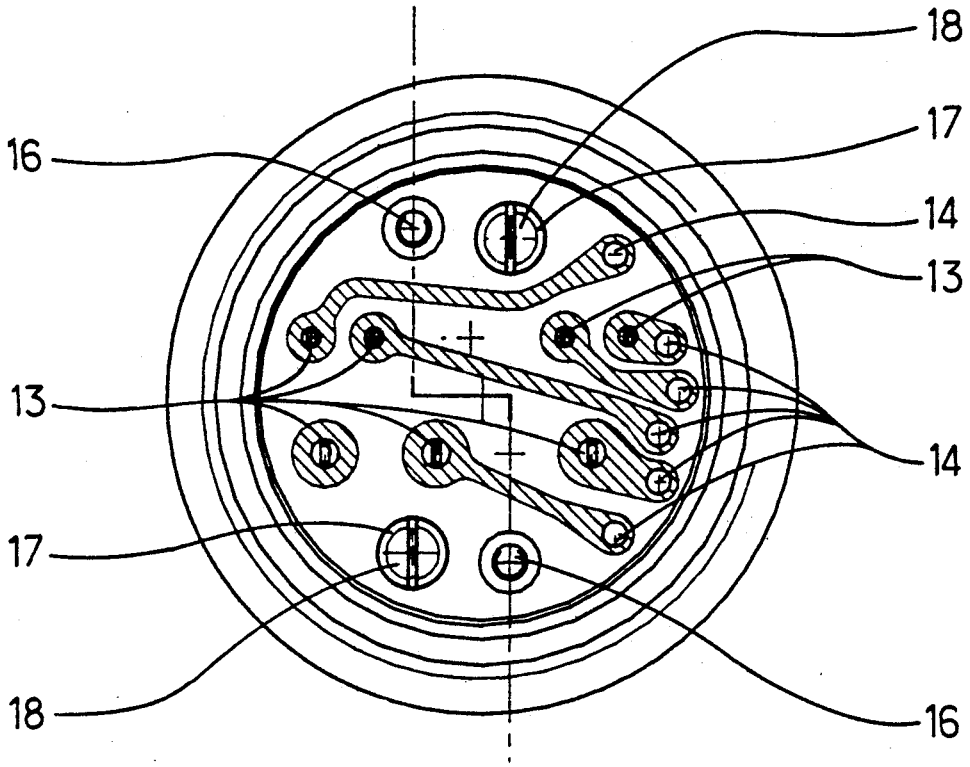
FIG. 3 is a bottom view of the device showing the electric connection board.
Figure 4:
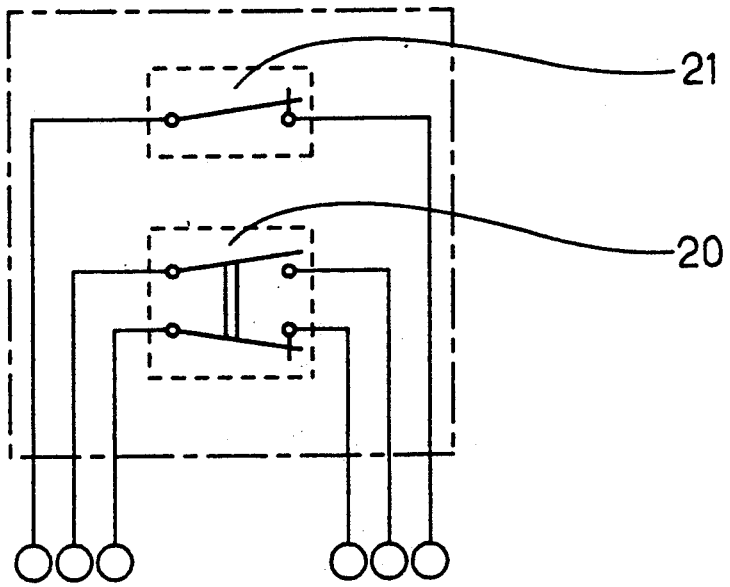
FIG. 4 shows the electric diagram of the device.

Such as it is shown in FIG. 3, which shows board 12 seen from chamber 11, said board 12 is pierced with holes 13 in a number corresponding to the electric output pins of switches 20, 21. For the present example, and as shown in FIG. 4, four pins are provided for the twin pole type switch 20 and three pins for the single pole type switch 21. Holes 13 each cooperate with one end of a metallized printed circuit track which brings the electric continuity towards the periphery of the board where the other end of each track is also pierced with a hole 14 for a soldered connection of the electric connecting wires leading outside the device, which wires are here gathered in a harness 15 as shown in FIG. 2.

The device is sealed at the level of the wire outlet by filling a cavity 19 with a flexible and adherent material, which could be provided by a packing.

Board 12 is pierced with two more holes 16 in which the operating means slide, which will be described further on and two other holes 17 for fixing board 12, here by means of two screws 18, on two bosses (not shown in the drawings) of case 1.

The two electric switches 20, 21 are each in the form of parallelepipedic cases having two large lateral faces and, depending on the thickness, two large sides and two small sides.

Button 22 for controlling the internal mechanism projects from one of the two large sides, the electric output pins 23 project from the opposite large side, a lever 24 may cooperate with the control button 22 (this lever 24 is shown in FIG. 2 and hides the corresponding control button).

As can be seen in FIGS. 1 and 2, the two switches 20, 21 are mounted on the face of board 12 opposite the above described printed circuit, applied against each other along one of their lateral faces substantially in a median plane containing the longitudinal axis of the device, pins 23 are fitted into holes 13 and soldered at 25 to the printed circuit tracks.

The means for operating each of the switches and the means for adjusting said operating means are housed in the volume included between the lateral faces of each of said switches opposite the lateral faces by which they are applied and the internal wall of case 1.

For each of the switches, for example switch 20 and with reference to FIGS. 1 and 2, the operating means comprise a part substantially in the form of an elongate cylindrical sleeve 30.

The sleeve comprises an axial tapping 31 over substantially half of its length, tapping 31 emerges into a recess 32 of greater diameter and over the remaining length of the sleeve.

Sleeve 30 further comprises a radial protuberance 33 in the form of a bracket of a length here substantially equal to the diameter of said sleeve.

A resilient return means, here a helical spring 34, is housed in recess 32, its height is greater than the depth of the recess, one of its ends bears against the bottom of recess 32, the other against the bottom of case 1.

Sleeve 30 is mounted for sliding along an axis parallel to the longitudinal axis of the device in a cylindrical guide of the case. Said guide being open along a generatrix so as to permit movement of bracket 33 held straight above lever 24 or control button 22 if the corresponding switch does not comprise a lever.

Advantageously, sleeve 30 is made from a semi rigid thermoplastic material for example of the polyamide type reinforced with glass fibres.

In the presently described example of the device of the invention, the means for adjusting the control means comprise a headless threaded rod 35, whose thread cooperates with the tapping 31 and which extends outwardly of sleeve 30 through one of the holes 16 in board 12 for cooperating by contact of one of its ends with washer 10. The other end of rod 35 is inside case 1 and is split so that it can be operated by an appropriate tool, in particular a screwdriver which will be inserted through spring 34. For this, and to make such adjustment possible from outside the case, the wall of the bottom of the case, in the axis of spring 34, is pierced with a hole 26 of a diameter less than the diameter of the spring, the hole is threaded, a screw 27 is housed therein for providing mechanical protection and sealing of the device.

Advantageously, the threaded rod 35 is of the three-lobe type, i.e. its section is not circular but has three lobes at 120°, thus the thread of each of the lobes forces its passage in the tapping of sleeve 30 and provides particularly efficient self-locking of threaded rod 35 with respect to sleeve 30. The length of the threaded rod 35, that of sleeve 30 and the position of bracket 33 along the axis of said sleeve are such that the corresponding switch can be controlled through the adjustment in any position of piston 8.

In the example of FIG. 1, switch 20 will be operated by piston 8 in a position of said piston close to one of its two end most positions (piston retracted), and switch 21 will be operated in a position of the piston close to the other of its two endmost positions (piston extended).

It should be noted that, if required, the device of the invention makes it possible, as can be clearly seen in FIG. 2, for a switch, as long as it has a control lever 24, to be mounted turned round by 180° with respect to the plane of the drawing about an axis parallel to the longitudinal axis of the device; under these conditions, control of the switch will be stepped down by the lever arm effect thus created.

Figure 5:
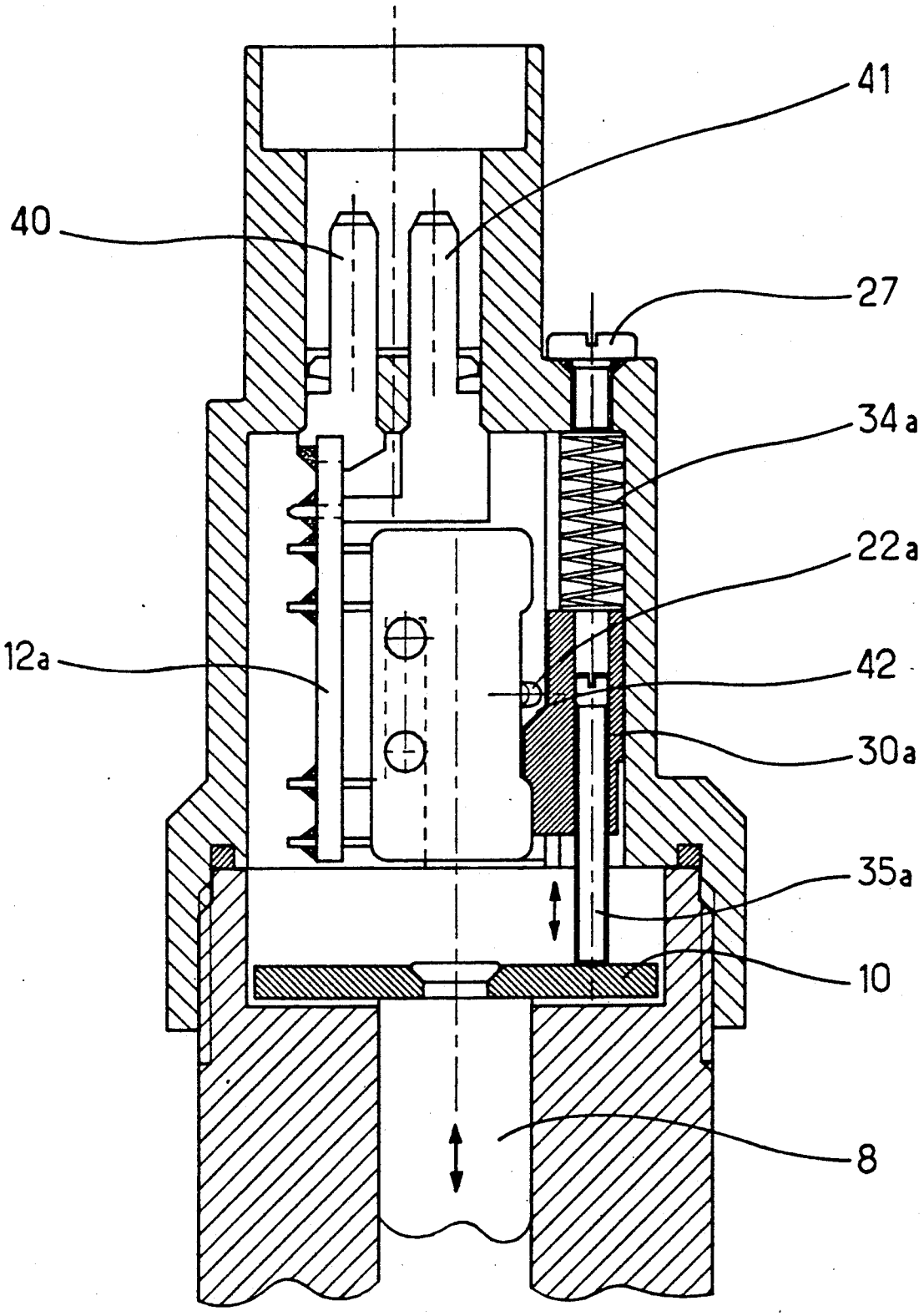
FIG. 5 is a variant in section of the described example of the device.

FIG. 5 shows a second example of the device of the invention; in this example, the printed circuit board **12*a* supporting the switches is mounted in a plane parallel to the axis of the device, the electric outputs are provided by pins, two of which 40, 41** appear in the drawings, on which pins a connector may be fitted.

The control means, the substantially cylindrical sleeve 38, is mounted for sliding along the large side of the switch with its control button **22*a***.

The control means **30*a* comprise a slanting ram 42, the adjustment means 35*a* is a headless threaded rod cooperating with the internal tapping of the control means 30*a***.

The displacement of piston 8 along the axis of the device actuates screw **35*a* and sleeve 30*a* against a resilient return means, the helical spring 34*a*, ramp 42 then actuates the control button 22*a*** of the electric switch.

Although the present invention has been described with reference to particular embodiments, it is however clear that it is not limited thereto and modifications thereto or variants can be made without departing from its scope and spirit. In particular, the number as well as the type of switches may vary.

The present invention makes it possible to construct electric switching devices which are readily adjustable, particularly robust and economic, suitable for the different industrial sectors, particularly the automobile industry.

What is claimed is:

1. An electric switching device for making or breaking the electric continuity between electric connecting elements under action of an external said device comprising: a casing; at least one electric switch positioned within said casing and having a control means therefore; movable operating means specific to each switch mounted in said casing for sliding movement along the switch, said operating means comprising a substantially cylindrical sleeve having a radially extending bracket directly cooperating with said control means, a tapping extending through said operating means in a direction parallel to the sliding direction of said operating means, and a rod threadedly cooperating with said tapping having a first end on which said external force is directly exerted and a second end which can be rotated by an appropriate tool passing through a wall of said casing for adjusting said rod with respect to said tapping; and resilient return means positioned within said casing corresponding to each operating means and being coaxially mounted therewith such that said return means acts against said operating means.

2. The electric switching device as claimed in claim 1, wherein said external force is exerted by a piston.

3. An electric switching device for making or breaking the electric continuity between electric connecting elements under action of an external force, said device comprising: a casing; at least one electric switch positioned within said casing and having a control means therefore; movable operating means specific to each switch mounted in said casing for sliding movement along the switch, said operating means comprising a substantially cylindrical sleeve having a ramp directly cooperating with said control means, a tapping extending through said operating means in a direction parallel to the sliding direction of said operating means, and a rod threadedly cooperating with said tapping having a first end on which said external force is directly exerted and a second end which can be rotated by an appropriate tool passing through a wall of said casing for adjusting said rod with respect to said tapping; and resilient return means positioned within said casing corresponding to each operating means and being coaxially mounted therewith such that said return means acts against said operating means.

4. The electric switching device as claimed in claim 3, wherein said sleeve is made from a semi rigid thermoplastic material particularly from polyamide reinforced with glass fibres, and said threaded rod is a three-lobe type.

* * * * *